US008438664B2

(12) United States Patent
Fee et al.

(10) Patent No.: US 8,438,664 B2
(45) Date of Patent: May 14, 2013

(54) RAPID INTERVENTION RESCUE HARNESS

(75) Inventors: Thomas J. Fee, South Hempstead, NY (US); Michael P. Fee, Northport, NY (US); Donna M. Haskell, West Islip, NY (US); Frank Haskell, West Islip, NY (US); Patricia A. Harty, West Islip, NY (US); Michael P. Harty, West Islip, NY (US)

(73) Assignee: Rescue Equipment Laboratories International, LLC, West Islip, NY (US)

( * ) Notice: Subject to any disclaimer, the term of this patent is extended or adjusted under 35 U.S.C. 154(b) by 164 days.

(21) Appl. No.: 12/862,495

(22) Filed: Aug. 24, 2010

(65) Prior Publication Data

US 2011/0030119 A1 Feb. 10, 2011

Related U.S. Application Data

(63) Continuation-in-part of application No. 11/438,899, filed on May 22, 2006, now Pat. No. 7,779,484.

(60) Provisional application No. 60/764,209, filed on Feb. 1, 2006, provisional application No. 60/790,742, filed on Apr. 8, 2006.

(51) Int. Cl.
*A41D 13/00* (2006.01)

(52) U.S. Cl.
USPC ..... 2/69

(58) Field of Classification Search ..... 2/69, 79, 2/81, 94, 227, 97, 456, 108, 305, 310; 182/3–7; 244/151 R, 143
See application file for complete search history.

(56) References Cited

U.S. PATENT DOCUMENTS

| | | | | | |
|---|---|---|---|---|---|
| 2,979,153 | A * | 4/1961 | Hoagland et al. | 182/3 |
| 4,449,253 | A * | 5/1984 | Hettinger | 2/93 |
| 4,682,671 | A * | 7/1987 | Hengstenberger et al. | 182/3 |
| 4,854,418 | A * | 8/1989 | Hengstenberger et al. | 182/3 |
| 5,036,548 | A * | 8/1991 | Grilliot et al. | 2/81 |
| 5,136,724 | A * | 8/1992 | Grilliot et al. | 2/81 |
| 5,279,386 | A * | 1/1994 | Cearley | 182/3 |
| 5,289,590 | A * | 3/1994 | Larson | 2/227 |
| 5,297,295 | A * | 3/1994 | Barbeau et al. | 2/96 |
| 5,738,046 | A * | 4/1998 | Williams et al. | 119/770 |
| 5,787,500 | A * | 8/1998 | Lobello | 2/1 |
| 5,960,480 | A * | 10/1999 | Neustater et al. | 2/456 |
| 5,970,517 | A * | 10/1999 | Jordan | 2/69 |
| 6,035,440 | A * | 3/2000 | Woodyard | 2/102 |
| 6,101,631 | A * | 8/2000 | Ferguson, Jr. | 2/94 |
| 6,105,169 | A * | 8/2000 | Colorado | 2/81 |
| 6,205,584 | B1 * | 3/2001 | Yocco | 2/69 |
| 6,244,379 | B1 * | 6/2001 | Larson | 182/6 |
| 6,256,789 | B1 * | 7/2001 | Young et al. | 2/69 |
| 6,421,834 | B2 * | 7/2002 | Kester | 2/94 |
| 6,427,252 | B1 * | 8/2002 | Lewis et al. | 2/326 |
| 6,490,733 | B1 * | 12/2002 | Casaubon | 2/81 |

(Continued)

*Primary Examiner* — Tejash Patel

(74) *Attorney, Agent, or Firm* — The Farrrell Law Firm, P.C.

(57) ABSTRACT

Rescue harness devices are designed for incorporation into protective coats of firefighter or other types of first responders such that when deployed, the rescue harness forms a closed loop that cinches around an upper torso region under the armpits of an individual donning the protective coat, to thereby positively secure the individual and pull directly on the individual's body.

11 Claims, 6 Drawing Sheets

U.S. PATENT DOCUMENTS 6,658,666 B2 * 12/2003 Schweer ..... 2/94
6,662,372 B2 * 12/2003 Lewis et al. ..... 2/69
6,668,386 B2 * 12/2003 Vidal ..... 2/100
6,698,026 B2 * 3/2004 Schweer ..... 2/94
6,892,395 B2 * 5/2005 Schweer ..... 2/94
7,779,484 B2 * 8/2010 Fee et al. ..... 2/69
7,971,273 B2 * 7/2011 Grilliot et al. ..... 2/81

* cited by examiner

RAPID INTERVENTION RESCUE HARNESS

PRIORITY

This application claims priority to U.S. Provisional Patent Application Ser. No. 60/764,209, filed Feb. 1, 2006, U.S. Provisional Patent Application Ser. No. 60/790,742, filed Apr. 8, 2006, and is a continuation-in-part of U.S. Non-Provisional patent application Ser. No. 11/438,899, filed May 22, 2006, the disclosures of which are incorporated herein by reference.

BACKGROUND OF THE INVENTION

1. Field of the Invention

The present invention relates generally to rescue harness devices that are designed to be incorporated into protective coats of firefighter or other types of first responders and, more specifically, protective coats equipped with integrated rescue harness devices that when deployed, are designed to form a closed harness loop that cinches around an upper torso region under the armpits of an individual donning the protective coat, to thereby positively secure the individual and pull directly on the body.

2. Brief Description of Related Art

Firefighters and other first responders to protect against heat, smoke and other harsh environmental conditions use various types of equipment. For instance, tire fighters typically wear protective, tire retardant coats and pants (turnout gear), etc. In addition, firefighters carry on their back an air tank of a self-contained breathing apparatus (SCBA) attached to a harness. While this protective gear is essential to safety, the protective equipment can make it very difficult to remove an unconscious or otherwise incapacitated firefighter from a building. Indeed, experience has shown that under various emergent circumstances, it is extremely difficult to remove a downed firefighter from a hazardous location unless some particular rescue device is employed to assist in effective and rapid removal.

Recently, consideration has been given to revise the Current National Fire Protection Association (NFPA) standards, in particular, the National Fire Protection Association (NFPA) 1971, to require that a DRD (drag rescue device) be incorporated into turnout coats of firefighters.

In general, a DRD is some form of strap or harness device that is installed in the turnout coat for the purpose of assisting in the removal of a downed firefighter by allowing other firefighters to engage the DRD and drag the downed firefighter to safety.

Various methods for implementing a standard DRD device have been proposed. For instance, some DRD designs have been proposed which are premised on the use of a SCBA harness as a removal mechanism. However, history has proven that during emergency situations, many firefighters actually remove the SCBA and are typically found unconscious without wearing the SCBA. In this regard, during an emergent situation, it can be difficult or virtually impossible for a firefighter to put the SCBA back on the fallen firefighter to thereby deploy the removal device.

Other devices and methods have been proposed for incorporating a rescue harness as part of the protective coat of firefighters. Some rescue harness designs are based on built in harness configurations where the harness straps are attached to the protective gear in such a manner that the protective gear itself is utilized to drag a person when the harness is deployed. These harness designs are not particularly effective as the protective gear is not sufficient to securely maintain an individual that is being dragged. Other harness designs that have been proposed are complex configurations that require a firefighter to manually engage many fasteners and make various adjustments, which can be burdensome. In emergent situations, a firefighter may not have the time or desire to fully or properly engage the rescue harness, rendering the harness ineffective or useless in an emergency situation. Moreover, such complex designs can be bulky and physically restrictive when donning the protective gear.

SUMMARY OF THE INVENTION

Exemplary embodiments of the invention include rescue harness devices that are incorporated into protective coats of firefighters or other types of first responders. For example, in one exemplary embodiment of the invention, a rescue harness device for use with a coat includes an elongated harness strap having a first end and a second end, and a harness handle coupled to the elongated harness strap. The rescue harness device is adapted to be incorporated inside the coat where the first and second ends of the elongated harness strap are disposed in a front region of the coat to allow an individual donning the coat to readily connect the first and second ends of the elongated harness strap and form a closed harness loop inside the coat, which encircles the upper torso region under the armpits of the individual. The rescue harness device is further adapted to be incorporated inside the coat such that the harness handle is disposed in a back region of the coat and coupled to a portion of the harness strap disposed in the back region of the coat, and such that the harness handle can be accessed through an opening formed in the exterior upper back region of the coat.

In another exemplary embodiment of the invention, a coat equipped with a rescue harness device includes an outer shell, an inner shell, and an opening formed in the outer shell in an upper back region of the coat. The rescue harness device includes an elongated harness strap having a first end and a second end, wherein the elongated strap is disposed between the outer and inner shells with the first and second ends of the elongated strap disposed in a front region of the coat. A connector is included to connect the first and second ends of the harness strap, to form a closed harness loop that encircles an upper torso region under an armpit region of the coat. A harness handle is coupled to the elongated harness strap in the back region of the coat, wherein the harness handle is disposed for access through the opening formed in the outer shell in the upper back region of the coat. The rescue harness device is designed such that when deployed, the closed harness loop cinches around an upper torso region under the armpits of an individual donning the protective coat, to thereby positively secure the individual and pull directly on the body.

These and other exemplary embodiments, aspects, features and advantages, of the present invention will become apparent from the following detailed description of exemplary embodiments, that is to be read in connection with the accompanying drawings.

DETAILED DESCRIPTION OF PREFERRED EMBODIMENTS

Figure 1:
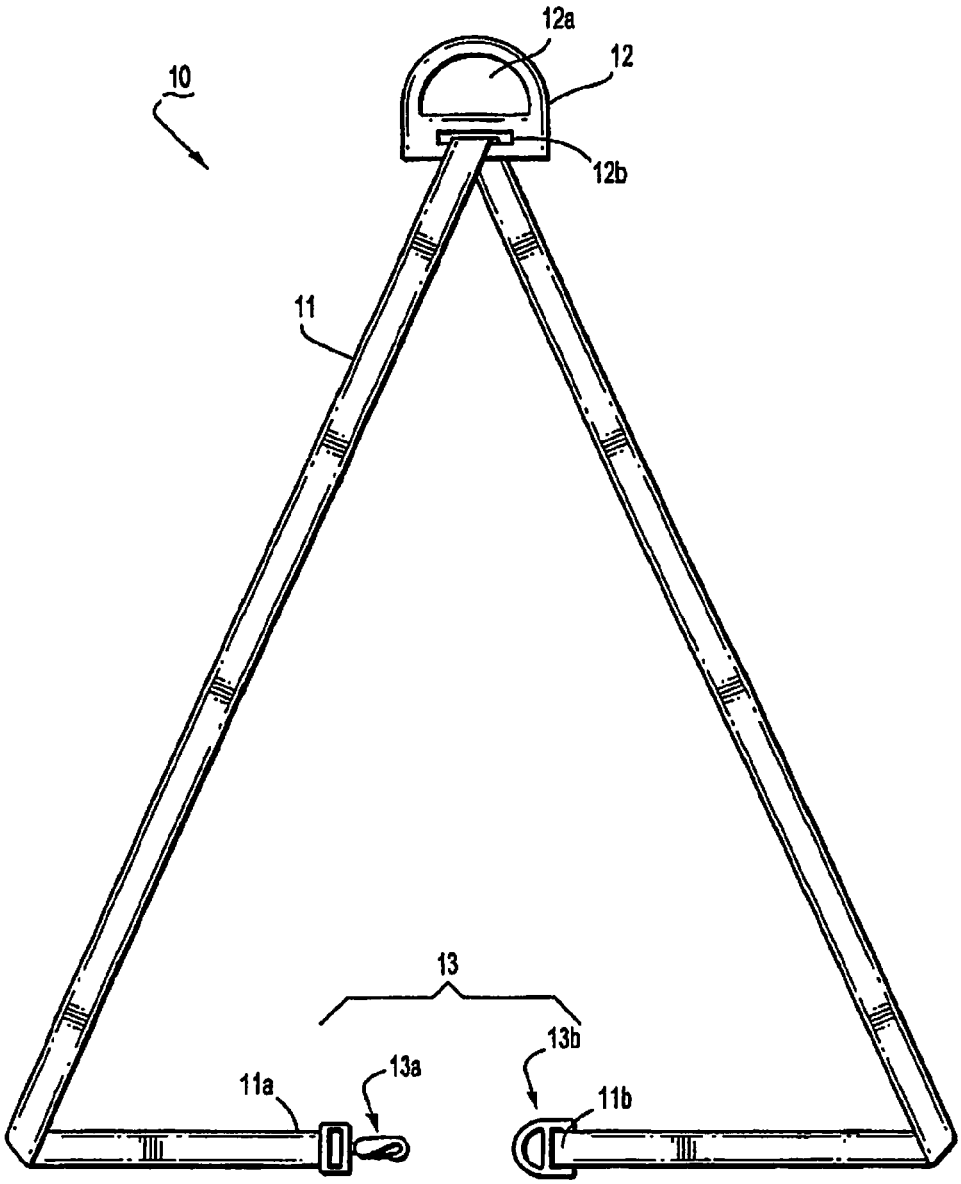
FIG. 1 schematically illustrates a rescue harness device according to an exemplary embodiment of the invention, which is adapted to be incorporated into a coat.

FIG. 1 schematically illustrates a rescue harness device (10) according to an exemplary embodiment of the invention, which is adapted to be incorporated into a 20 protective coat used by a firefighter or other first responder. In general, the rescue harness device (10) comprises an elongated harness strap (11) having a first end (11*a*) and a second end (11*b*), a harness handle (12), and a connector (13). The connector (13) comprises first and second mating connector elements (13*a*) and (13*b*), wherein the first mating connector element (13*a*) is coupled to the first end (11*a*) of the elongated harness strap (11) and wherein the second mating connector element (13*b*) is coupled to the second end (11*b*) of the elongated harness strap (11).

In one exemplary embodiment of the invention as illustrated in FIG. 1, the connector (13) includes a clip/loop fastener mechanism wherein the first mating connector element (13*a*) is a metallic locking clip (or snap clip) and the second mating connector element (13*b*) is a metallic ring (e.g., D-ring or bull ring).

The harness strap (11) may be formed of any suitable strapping or webbing material that is rated for a desired strength and durability for the intended purposes. For example, in firefighting applications, the harness strap (11) may be a flexible, 1"~2" tubular webbing that is formed of non-abrading and flame-resistant material using, for example, aramid fibers such as Kevlar® and Nomex®. In other exemplary embodiment, the harness strap (11) may be formed of nylon, polyester or other materials that are suitable for the given application.

The harness handle (12) is a metallic ring element (e.g., D-ring) that includes a ring portion (12*a*) and strap receiving portion (12*b*). The ring portion (12*a*) provides means for engaging the harness handle (12) by hand or connecting the harness handle (12) to a safety line device or other equipment. In one embodiment of the invention, the harness strap (11) is looped through the strap receiving portion (12*b*) of the handle (12) such that the handle (12) is slideably engaged with the harness strap (11). In other words, the handle (12) is not fixedly attached at some point along the length of the harness strap (11) but rather the handle (12) can slide along the length of the harness strap (11) as necessary, or the harness strap (11) can readily pass through the opening (12*b*) as necessary. In this manner, the handle (12) does not restrict movement and positioning of the harness strap (11) when the handle (12) is in a stowed position, and allows the handle (12) to self-position at the apex of a closed harness loop formed by the harness strap (11) during deployment of the rescue harness (10) so as to self-equalize the forces in the harness strap (11) and ensure that the entire harness strap remains taut on both side of the handle (12) during deployment. In other embodiments, the handle (12) may be fixedly coupled to a point on the harness strap (11), e.g., at a midpoint between the, first and second ends (11*a*/11*b*).

Figure 2:
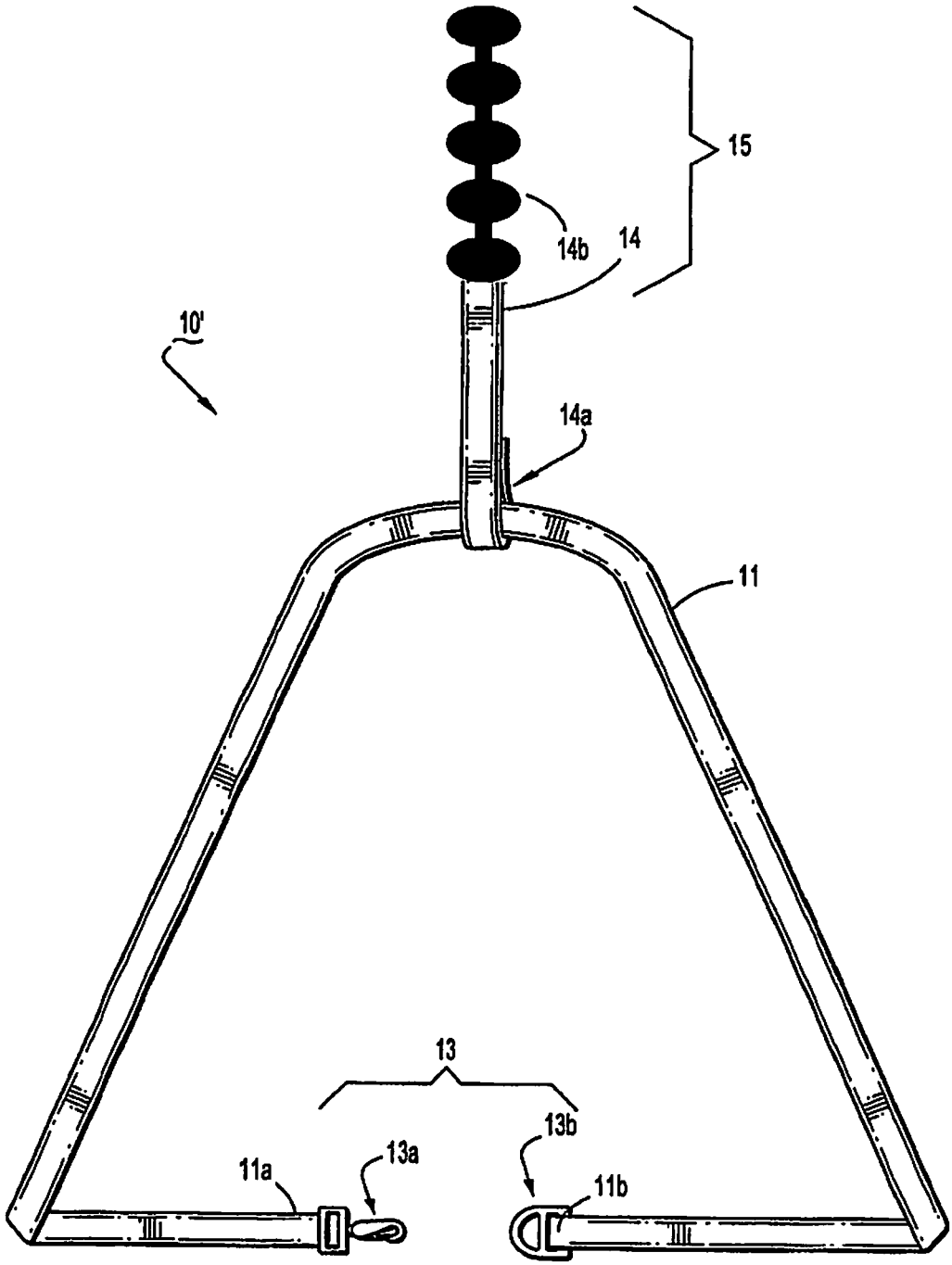
FIG. 2 schematically illustrates a rescue harness device according to another exemplary embodiment of the invention, which is adapted to be incorporated into a coat.

FIG. 2 schematically illustrates a rescue harness device (10') according to another exemplary embodiment of the invention, which is adapted to be incorporated into a protective coat used by a firefighter or other first responder, for example. The exemplary rescue harness device (10') depicted in FIG. 2 is similar to the rescue harness device (10) depicted in FIG. 1, but with an additional elongated strap (14). This embodiment preferably includes the harness strap (11) connected to a first end (14*a*) of the elongated strap (14). The first end (14*a*) can be connected to the harness strap (11) such that it is fixed in position, or preferably, the first end (14*a*) is slidably engaged such that it can articulate along the harness strap (11).

The elongated strap (14) preferably includes a beaded portion (14*b*) having one or more beads to form a harness handle (15). The beaded portion (14*b*) allows for easier grip and avoids the problems associated with loop-type handles that can become tangled or caught on exterior objects during a firefighter's or first responder's use. The beads of the beaded portion (14*b*) are positioned such that the fire fighter(s) or first responder(s) can easily grip the handle with one or two hands to pull the downed fire fighter or first responder to safety.

A further preferred embodiment of the present invention includes the beaded handle (14*b*) located in the front chest region of the firefighter or first responder (not shown), wherein the beaded handle (14*b*) is preferably connected either adjacent to, and attached at least one point, or surrounding the connector (13), and attached at least two points.

The exemplary rescue harness devices (10) and (10') can be readily incorporated into a protective coat in a seamless manner using exemplary methods as described herein below. In general, the exemplary rescue harness devices (10) and (10') are adapted to be fitted on the inside of a protective coat, such that the first and second ends (11*a*) and (11*b*) of the elongated harness strap (11) are disposed in a front region of the coat to allow an individual donning the coat to readily connect the first and second ends (11*a*/11*b*) using the connector (13) to form a closed harness loop in the interior of the coat which encircles an upper chest region under the armpits of the individual. Moreover, the rescue harness devices (10) and (10') are adapted to be fitted on the inside of a protective coat, such that the harness handles (12) or (15) are disposed in a back region of the coat, and can be accessed through an opening formed in the exterior upper back region of the coat.

Figure 3A:
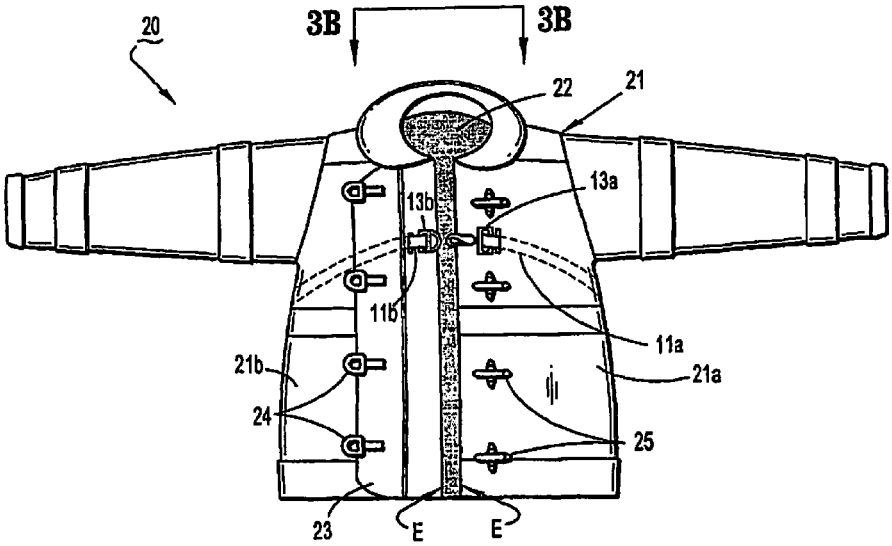
FIGS. 3A, 3B, 3C and 3D are various schematic views of a protective coat, which illustrate methods for incorporating the exemplary rescue harness devices of FIGS. 1 and 2 into the protective coat, according to exemplary embodiments of the invention.
Figure 3B:
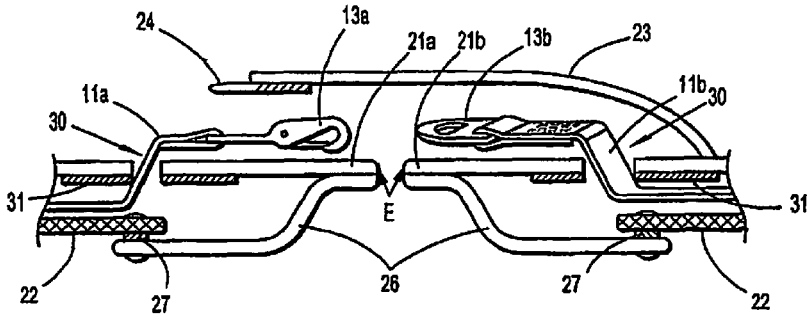
Figure 3C:
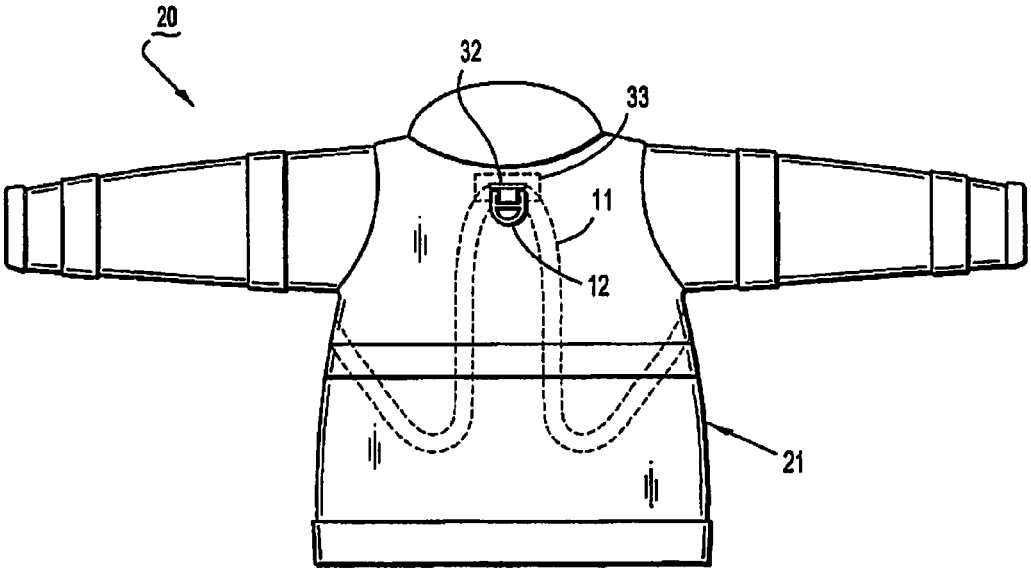
Figure 3D:
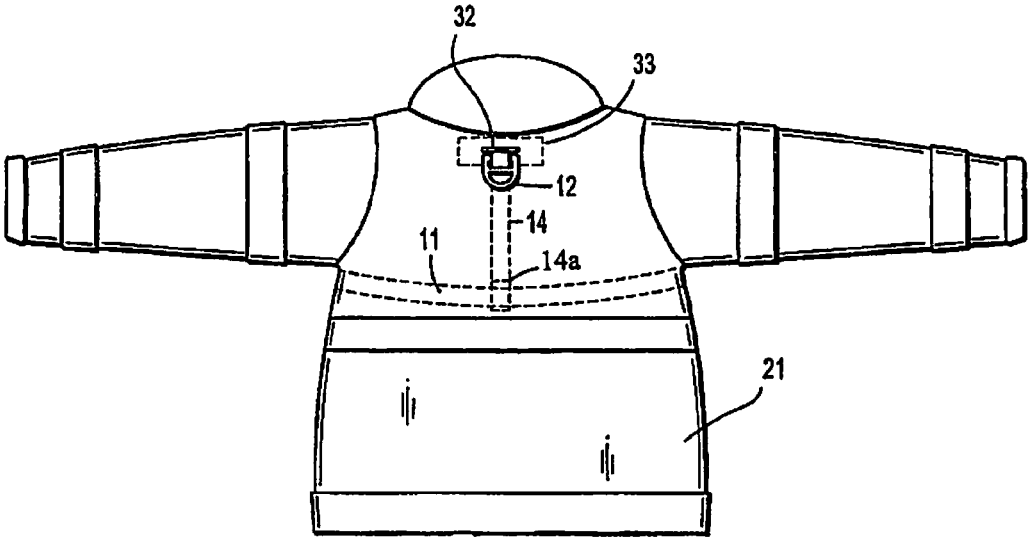

For instance, FIGS. 3A, 3B, 3C and 3D schematically illustrate methods for incorporating the exemplary rescue harness devices (10) and (10') into a protective coat (20) of a firefighter, according to exemplary embodiments of the invention. FIGS. 3A and 3B schematically illustrate a method, which is applicable to both rescue harness (10) and (10') designs, for disposing the harness loops (11) in the interior region of the protective coat (20) with the connectors (13*a*/13*b*) at the ends (11*a*/11*b*) of the harness loops (11) being disposed on the exterior chest region of the coat (20). FIGS. 3C and 3D schematically illustrate methods, which are applicable to respective rescue harness devices (10) and (10'), for positioning and fitting the harness loops (11) and harness handles (12) and (15) in the back region of the protective coat (20).

In particular, FIG. 3A is a front schematic view of the protective coat (20) as equipped with either rescue harness device (10) or (10'), according to an exemplary embodiment of the invention. FIG. 3B is a cross-sectional schematic view of a front portion of the protective coat in FIG. 3A taken at view line 3B-3B at a point on the front portion of the coat (20) where the connecting ends (11*a*/11*b*) of the harness loop (11) with the connectors (13*a*/13*b*) are disposed. In general, the protective coat (20) comprises an outer shell (21) and inner shell (22), which is substantially coextensive with the outer shell (21). The outer and inner shells (21) and (22) can be made of well-known fireproof and insulative materials, respectively, that are commonly used to meet NFPA standards for firefighting applications (although other materials may be used for coats designed for applications other than firefighting).

As illustrated in FIGS. 3A and 3B, the front side of the outer shell (21) includes a left front panel (21*a*) and a right front panel (21*b*) each having an edge (E) that forms an opening in the front side of the coat (20). A plurality of fasteners (not shown) such as snaps or hook and pile fasteners (e.g., Velcro® strips) can be attached at locations along the edges (E) of the front panels (21*a*) and (21*b*) to close the coat (20). An outer cover flap (23) is attached along one edge thereof to the right front panel (21*b*) of the outer shell (21). The outer cover flap (23) is what is sometimes referred to as a "storm flap". The cover flap (23) can be detachably fastened to the left front panel (21*a*) via corresponding loop (24) and hook (25) fasteners (or other fasteners), as is known in the art. The outer cover flap (23) is typically formed of the same material as the outer shell (21).

Further, as illustrated in FIG. 3B, the protective coat (20) includes inner flaps (26) that extend along, and are attached to, respective edges (E) of the front panels (21*a*) and (21*b*) of the outer shell (21). The inner flaps (26) provide means for attaching the inner insulative shell (22) to the outer shell (21) near the front opening of the coat (20). The inner flaps (26) are attached to inner shell (22) using corresponding mating fasteners that extend along the mating edges of the inner shell (22) and the inner flaps (26). For example, the inner shell (22) can be attached to the inner flaps (26) via corresponding snap buttons (27) that are disposed along the mating edges of inner shell (21) and inner flaps (26) (see, also FIG. 5A). In other embodiments, any other suitable attachment means such as zippers, hook/pile fasteners, etc., can be used to attach mating edges of the inner flaps (26) and the inner liner (22).

As generally illustrated in FIGS. 3A-3D, the rescue harness devices (10) and (10') are incorporated in an upper torso region of the coat (20) where, in general, the harness strap (11) is disposed inside the coat (20), preferably between the outer shell (21) and inner shell (22) layers.

As depicted in FIGS. 3A and 3B, the clip (13*a*) and loop (13*b*) fasteners, which are connected to the respective ends (11*a*) and (11*b*) of the harness strap (11), are located on the exterior of the outer shell (21) in the chest regions of respective front panels (21*a*) and (21*b*). The end portions (11*a*) and (11*b*) of the harness strap (11) pass through small slits (or apertures) (30) that are formed through the outer shell (21) layer of respective front panels (21*a*) and (21*b*).

Depending on the desired application, the connecting ends (11*a*/11*b*) of the harness strap (11) may be fixedly attached, removably attached, or completely unattached to the protective coat (20). For example, FIG. 3B illustrates an embodiment where the first and second end portions (11*a*/11*b*) of the elongated harness strap (11) are not connected to any portion of the coat, but simply pass through the openings (30) in the outer shell (21). The end portions (11*a*) and (11*b*) of the strap (11) can be removably coupled to the inner or outer surface of the outer shell (21) using, for example, snap buttons, a hook/pile fasteners (Velcro®), releasable straps, etc, and other suitable fasteners known to those of ordinary skill in the art for securing harness straps in removably secured positions on garments. Such fasteners provide means to maintain the positioning of the strap ends (11*a*) and (11*b*) near the chest region for engagement of the harness devices (10) or (10') when donning the coat, while allowing the rescue harness devices (10) or (10') to be readily removed for replacement or when washing or decontaminating the inner and outer shells (22) and (21).

In other embodiments, the connecting ends (11*a*/11*b*) of the harness strap (11) can be fixedly or removably attached to the outer shell (21) and/or the cover flap (23) such that the first and second mating connector elements (13*a*/13*b*) are adapted to serve as a closure mechanism for closing the coat. For instance, in FIG. 3B, the connector (13*b*) can be secured to the end of the cover flap (23) in place of the loop fastener (24), such that the connector (13*b*) can couple to the mating connector (13*a*) coupled to the outer shell (21) and thereby function as a mechanism for closing the coat (20) similar in function to the corresponding Fasteners (24) and (25) in FIG. 3A.

Reinforcement layers (31) are preferably employed to maintain the integrity of the outer shell (21) in the regions where the slits (30) are formed. For example, the reinforcement layers (31) may comprise patches formed of strong flexible material, such as leather patches, which are stitched on the interior surface of the outer shell (21) as shown in FIG. 3B. In other embodiments, the reinforcement layers (31) may be formed of suitable material to be stitched on the exterior surface of the outer shell (21). Depending on the desired application, the end portions (11*a*, 11*b*) of the harness strap (11) and/or the fasteners (13*a*, 13*b*) may be fixedly attached to the respective reinforcement devices (31) on the front panels (21*a*), (21*b*).

Furthermore, as illustrated in FIG. 3C', the harness handle (12) is disposed on the exterior of the outer shell (21) in the upper back region of the coat (20) just below the neck region. A reinforced slit or aperture (32) is formed in the outer shell (21), which is designed to allow passage of the strap (11) when the harness (10) is deployed, while preventing the handle (12) from passing through to the inside of the outer shell (21). A reinforcement device (33) may be provided to maintain the integrity of the outer shell (21). For example, as noted above, the reinforcement device (33) may comprise strong flexible material such as leather that is stitched on the inside of the outer shell (21). The aperture (32) may be further reinforced with a metallic or otherwise heat resistant material around a perimeter thereof (e.g., oval ring or frame structure) as a means to withstand damage or ripping of the material due to fray and frictional forces from the strap (11) material during deployment of the harness (10).

As depicted in FIGS. 3A and 3C, the harness strap (11) (shown in phantom by dotted lines) of the rescue harness device (10) of FIG. 1 is loosely disposed inside the coat (20) between the inner and outer shells (21) and (22). The harness strap (11) extends from the first end portion (11*a*) in the upper chest region of the front left panel (21*a*) down and around the left interior side of the coat (20) under the armpit portion and up the back where the harness strap (11) loops through the strap receiving portion (12*b*) of the handle (12) and then down the back and around the right interior side of the coat (20) under the armpit portion and up to the second end portion (11*b*) in the upper chest region of the right front panel (21*b*). The harness strap (11) is designed to have a suitable length such that when the rescue harness (10) is not deployed, the harness strap (11) has 20 sufficient slack to fit loosely around the firefighter's torso to allow the individual to move freely and comfortably. The excess slack of the strap (11) can be located down the back inner side of the protective shell (20) such as shown in FIG. 3C.

Similarly, as depicted in FIGS. 3A and 3D, the harness strap (11) (shown in phantom by dotted lines) of the rescue harness device (10') of FIG. 2 is loosely disposed inside the coat (20), preferably between the inner/outer shells (22), (21). The harness strap (11) extends from the first end portion (11*a*) in the upper chest region of the front left panel (21*a*) down and around the left interior side of the coat (20) under the armpit portion and around the back where the harness strap (11) connects to the first end (14*a*) of the elongated strap (14) and then back around the right interior side of the coat (20) under the armpit portion and up to the second end portion (11*b*) in the upper chest region of the right front panel (21*b*). The harness strap (11) is designed to have a suitable length such that when the rescue harness (10) is not deployed, the harness strap (11) has sufficient slack to fit loosely around the firefighter's torso to allow the individual to move freely and comfortably. The elongated strap (14) is located down the back inner side of the protective shell (20) such as shown in FIG. 3D.

Figure 4:
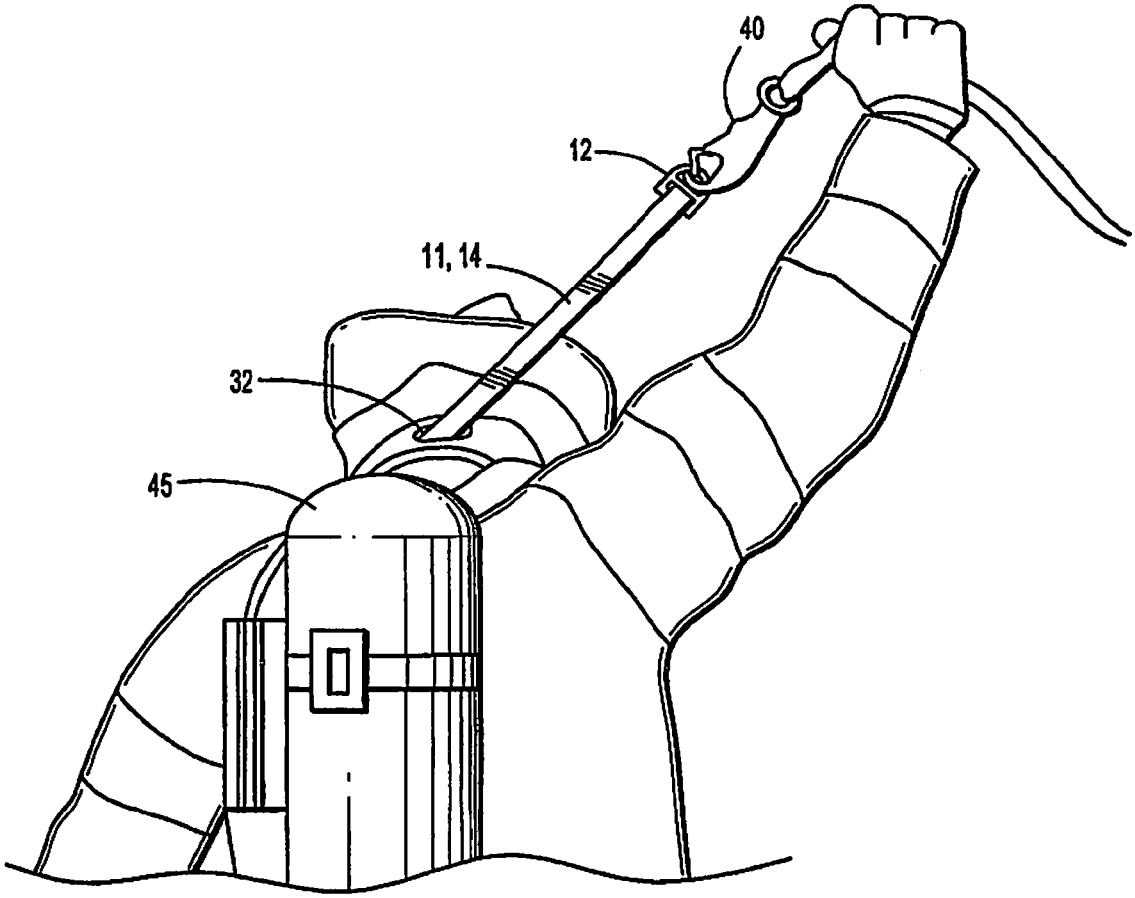
FIG. 4 illustrates a method for using rescue harness devices incorporated in protective coats, according to an exemplary embodiment of the invention.

It is to be appreciated that the rescue harness devices (10) and (10') are incorporated in the protective coat (20) such that when deployed, the harness straps (11) form a closed harness loop that cinches across the chest region and under the armpits and around the back region to positively secure the individual donning the coat and pull directly on the body. FIG. 4 illustrates a state in which either rescue harness (10) or (10') is ready to be deployed by pulling the harness handle (12) at the access point located on the outside of the shell (21) on the upper back region below the neck region (rescue harness 10' not shown). The rescue harness (10) or (10') is deployed by pulling the handle (12) such that the excess slack of the strap (11), (14) is pulled out through the aperture (32) causing the closed harness loop (formed by the harness strap (11) with connected ends (11*a*/11*a*) to tighten around the individual's upper torso under the armpits.

When the rescue harness (10') is deployed by pulling the harness handle (15), the elongated strap (14) extends out from the aperture (32). In this exemplary embodiment, the length of the harness strap (11) and elongated strap (14) can be designed such that when the drag harness device (10') is deployed, the first end (14*a*) of the strap (14) does not extend out, from the aperture (32) at the point where the harness strap (11) is tightly secured around an individual being dragged (or lifted).

In addition, FIG. 4 illustrates one way in which the rescue harness (10) or (10') can be used by connecting the rescue harness handle (12) to a safety line (40). In this regard, the rescue harness (10) or (10') is designed to be readily self-deployable by a firefighter to be used as a self-escape device by connecting to the safety line (40) for vertical lifting. Moreover, the rescue harness (10) or (10') can be used to facilitate the quick removal of an unconscious or otherwise injured firefighter from a hazardous location by grabbing and pulling the handle (12) by hand to deploy the rescue harness (10) or (10') and drag a downed firefighter to safety. Depending on the application, the types of devices and materials that are used for the harness strap (11), harness handles (12) or (15), and connectors (13) can vary to provide the proper rating for strength, environmental conditions, etc., to support vertical lifting and/or horizontal dragging.

Moreover, as depicted in FIG. 4, for example, the access point of the handle (12) is strategically located to allow easy access to the handle (12) for self-deployment or deployment by another. The harness handle (12) is located in such a manner that deployment and operation is possible while an incapacitated fire fighter is wearing an SCBA (45), as shown in FIG. 4. Access to the handle (12) and operation of the harness device (10) or (10') does not require or cause the SCBA (50) to be removed, as wearing of the SCBA (45) does not interfere with deployment, access or operation of the rescue harness (10) or (10').

In another exemplary embodiment of the invention, a readily removable fire retardant and protective flap can be located on the outer shell (21) to cover the exposed harness handle (12) when the harness is not deployed. For instance, the flap can be made of the same or similar material as the outer shell (21) and fastened in place using Velcro, for instance. A cover flap can be placed over the exposed portion of the access handle (12) or (15) to protect the handle (12) or (15) and exposed portions of the harness strap (11) from harsh environmental conditions and protect against accidental deployment and pulling of the handle (12).

Figure 5A:
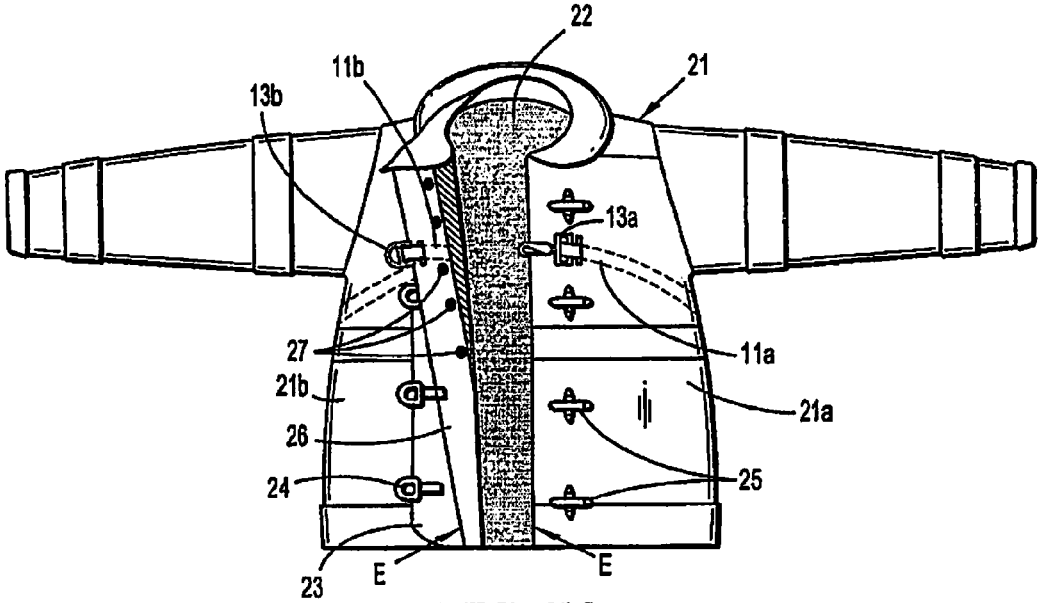
FIGS. 5A and 5B are schematic views of a protective coat, which illustrate methods for incorporating the exemplary rescue harness devices of FIGS. 1 and 2 into the protective coat according to further exemplary embodiments of the invention.
Figure 5B:
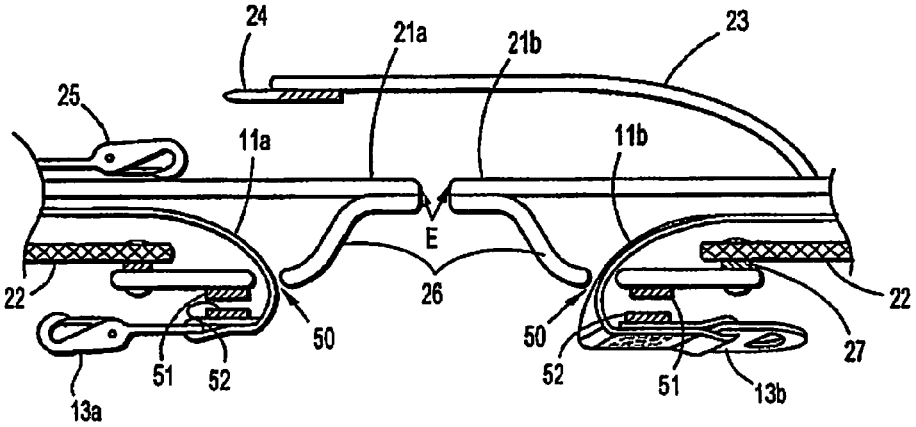

Other exemplary embodiments for integrating the harness devices (10) or (10') in the protective coat (20) will now be discussed with reference to FIGS. 5A and 5B. FIG. 5A is a schematic perspective front view of the protective coat (20) wherein the connecting ends (11*a*, 11*b*) of the harness strap (11) extend through apertures (50) formed through inside layers of the coat (20) near the chest region (as opposed to penetrating the outer shell (21) in FIG. 3B, for example). FIG. 5B is a schematic cross-sectional view of the inner and outer shells (22, 21) of the coat (20) in the chest region of the coat (20) opening where the connecting ends (11*a*, 11*b*) of the harness strap (11) extend from between the inner and outer shells (22, 21).

The inner flaps (26) include apertures (50) formed in a chest region of the coat (20). The apertures (50) allow the ends (11*a*/11*b*) of the harness strap (11) with the connectors (13*a*/13*b*) to extend from the cavity region between the outer shell (21) and inner shell (22) such that the ends (11*a*/11*b*) of the harness strap (11) with the connectors (13*a*/13*b*) are disposed inside the coat (20) near the edges (E) of the left and right chest panel regions (21*a*, 21*b*) near the front opening of the coat (20).

In one exemplary embodiment, the harness strap (11) is not fixedly attached to the coat (20). Various methods may be used to ensure that the connecting ends (11*a*/11*b*) of the strap (11) are maintained exposed in proper place in the chest region, e.g., that the ends of the strap (11) do not slip through the apertures (50) and into the inner region between the outer shell (21) and inner shell (22).

For instance, in one exemplary embodiment, the inner aperture (50) can be shaped and dimensioned relative to the connector fasteners (13*a*/13*b*) such that the fasteners (13*a*/13*b*) could not easily slip through the inner apertures (50). In one embodiment, when the inner apertures (50) are designed to prohibit passage of the fasteners (13*a*/13*b*), then one or both of the fasteners (13*a* or 13*b*) can be removably attached to the respective ends (11*a*, 11*b*) of the harness strap (11) using tri-bar-type fasteners, for example, so that the fasteners can be removed and thereby allow the strap ends (11*a*/11*b*) to pass through the apertures (50). In another exemplary embodiment, the fasteners (13*a*/13*b*) can be designed to be smaller in one dimension that the size of the apertures (50) such that the fasteners (13*a*/13*b*) can be physically manipulated through the respective apertures (50) when removing the rescue harness device (10) or (10'), but yet will not readily pass through the apertures (50) under normal usage of the coat (20).

In other exemplary embodiments of the invention, the connecting ends (11*a*/11*b*) of the harness strap (11) can be maintained in a removably fixed position using Velcro or snap button fasteners, and the like. For instance, as depicted in FIG. 5B, a first portion (51) of a fastener can be attached to the inner flap (26) and a second portion (52) of the fastener can be attached to some point on the exposed connecting end of the strap (11), such that the first and second portions (51/52) can be engaged to store/maintain the exposed ends of the harness strap (11) against the inside of the coat (20), and prevent the connecting ends of the harness strap (11) from slipping through the apertures (50) into the inner cavity between the outer shell (21) and inner shell (22).

In such embodiment, the fasteners (51/52) can be positioned such that the harness fasteners (13*a*/13*b*) can be engaged either with or without detaching the ends of the strap (11) from the inner flap (26). Even when the connecting ends of the strap (11) remain attached to the inner flap (26) (via fasteners (51/52) when the harness (10) is engaged (i.e. the ends (11*a*/11*b*) of the strap (11) are coupled via connector (13)), the fastener portions (51/52) can be designed to decouple from each other due to the pulling force that is exerted when the harness (10) or (10') is deployed, thereby allowing the harness strap (11) to even more freely move and tightly cinch around the torso of the individual.

It is to be understood that the embodiments described above are merely exemplary of general inventive concepts of the invention. The manner in which the rescue harness devices (10) or (10') can be integrated within a protective coat, can vary depending on the intended application, the construction of the coat, and other factors and considerations that one or ordinary skill in the art would readily consider. For instance, in the exemplary embodiment of FIGS. 3A/3B, the rescue harness is integrated such that an aperture is formed in a region of the outer shell (21) that is covered by the storm flap (23). In such instance, the aperture (30) in the shell (21) could be covered by the storm flap (23) preventing the external elements from entering through the aperture (30) into the inner space between the inner and outer shells (22) and (21) (although protective patches may be formed over the apertures (30) on the interior surface of the outer shell (21)).

In another embodiment, the fasteners (51/52) in FIG. 5B can be used to attach the harness strap (11) to the inner surface of the shell (21), the inner surface of the flap (26), or the inner shell (22) in the inner space region between the inner and outer shells (22), (21).

It is to be further understood that the exemplary drag rescue harness devices depicted in FIGS. 1 and 2 are merely exemplary embodiments and the general inventive concepts of the invention may be embodied in many forms readily envisioned by one of ordinary skill in the art. For instance, instead of using a metallic D ring handle (12), a grab handle can be formed of a loop of strap material as is known in the art. Moreover, rescue harness devices (10) or (10') according to exemplary embodiments of the invention may be designed using various types of fasteners and connectors depending on the intended use and safety requirements.

In exemplary embodiments of the invention as described herein, the harness device (10) is integrated in a manner such that the harness device (10) operates completely or substantially independently of the protective coat and such that when deployed, the harness (10) secures/cinches the firefighter by the upper torso/shoulders and pulls directly on the body, not the protective coat. The exemplary harness frameworks provide cost effective designs that enable ease of integration with existing protective gear with minimal modification. The rescue harnesses (10) or (10') can be integrated into a protective coat without causing discomfort to person using the protective coat. Moreover, by integrating the rescue harness (10) or (10') inside the outer protective shell (21), the harness strap material is protected from damage that can result from exposure to the harsh elements of firefighting. Moreover, locating the harness strap (11) between the inner and outer shells (21) and (22) helps to maintain the loose strap in proper position and prevent the strap from being entangled when the coat (20) is being worn.

Moreover, in one exemplary embodiment described above, the invention provides a firefighter with preparedness just by wearing the turnout gear without the need for additional equipment. Indeed, all that is required to engage the rescue harness devices (10), (10') is to Fasten the connectors (13*a*/13*b*), which can be performed as part of the normal procedure when donning the protective coat (20), in instances where the connectors (13*a*/13*b*) are actually used to close the coat (20).

Additionally, the rescue harness (10) or (10') can be incorporated into various protective coats not limited to those used by fire fighters and first responders. For example, the rescue harness (10) or (10') can be incorporated into a military coat or uniform, a child safety vest, an electrical or construction worker's vest, or a life preserver.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A garment incorporating a rescue harness, the garment comprising:

a harness strap having first and second connectable opposed ends, with the first and second connectable opposed ends being accessible from a front region of the garment by an individual wearing the garment; and a harness handle coupled to the harness strap between the first and second connectable opposed ends thereof, wherein connection of the first opposed end to the second opposed end of the harness strap forms a harness loop encircling an upper torso region of the individual, wherein, when the first opposed end is connected to the second opposed end, the rescue harness is deployed by pulling the harness handle, thereby tightening the harness strap across the upper front chest region, beneath the individual's armpits.

2. The garment of claim 1, wherein the first opposed end connects with the second opposed end when the individual closes the garment.

3. The garment of claim 2, wherein closures for the garment includes clasps, buttons and a zipper.

4. The garment of claim 1, wherein the harness handle includes one or more beads at a distal end thereof.

5. The garment of claim 4, wherein the harness handle is accessible from an upper back region of the garment.

6. The garment of claim 1, wherein the harness handle is accessible from the front region of the garment.

7. The garment of claim 4, wherein the garment is a protective firefighter coat.

8. The garment of claim 1, wherein the garment is a safety vest.

9. The garment of claim 1, wherein the rescue harness is utilized as a child safety harness.

10. A garment incorporating a rescue harness, the garment comprising:

a harness strap having first and second connectable opposed ends, with the first and second connectable opposed ends being accessible from a front region of the garment by an individual wearing the garment; and a harness handle including a strap receiving portion, wherein the harness handle is coupled to the harness strap between the first and second connectable opposed ends thereof, wherein connection of the first opposed end to the second opposed end of the harness strap forms a harness loop encircling an upper torso region of the individual, wherein, when the first opposed end is connected to the second opposed end, the rescue harness is deployed by pulling the harness handle, thereby tightening the harness strap across the upper front chest region, beneath the individual's armpits, and wherein the harness strap is looped through the strap receiving portion of the handle to allow for slidable engagement of harness handle with the harness strap.

11. A garment incorporating a rescue harness, the garment comprising:

a harness strap having first and second connectable opposed ends, with the first and second connectable opposed ends being accessible from a front region of the garment by an individual wearing the garment; and a harness handle coupled to the harness strap between the first and second connectable opposed ends thereof, wherein connection of the first opposed end to the second opposed end of the harness strap forms a harness loop encircling an upper torso region of the individual, wherein, when the first opposed end is connected to the second opposed end, the rescue harness is deployed by pulling the harness handle, and wherein the first and second connectable opposed ends are adapted to serve as a closure mechanism for closing the garment.

* * * * *